US006529874B2

(12) United States Patent
Kagoshima et al.

(10) Patent No.: US 6,529,874 B2
(45) Date of Patent: Mar. 4, 2003

(54) CLUSTERED PATTERNS FOR TEXT-TO-SPEECH SYNTHESIS

(75) Inventors: Takehiko Kagoshima, Hyogo-ken (JP); Takaaki Nii, Osaku-fu (JP); Shigenobu Seto, Hyogo-ken (JP); Masahiro Morita, Hyogo-ken (JP); Masami Akamine, Hyogo-ken (JP); Yoshinori Shiga, Kanagawa-ken (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/149,036

(22) Filed: Sep. 8, 1998

(65) Prior Publication Data

US 2001/0051872 A1 Dec. 13, 2001

(30) Foreign Application Priority Data

Sep. 16, 1997 (JP) ..... 9-250496

(51) Int. Cl.[7] ..... G10L 13/08
(52) U.S. Cl. ..... 704/269; 704/260; 704/245
(58) Field of Search ..... 704/258–269, 704/254, 207, 245, 220

(56) References Cited

U.S. PATENT DOCUMENTS 4,696,042 A * 9/1987 Goudie ..... 704/254
5,384,893 A * 1/1995 Hutchins ..... 704/258
5,682,501 A * 10/1997 Sharman ..... 704/260
5,740,320 A * 4/1998 Itoh ..... 704/267
5,832,434 A * 11/1998 Meredith ..... 704/260
5,913,193 A * 6/1999 Huang et al. ..... 704/258
5,913,194 A * 6/1999 Karaali et al. ..... 704/259
5,949,961 A * 9/1999 Sharman ..... 704/260
5,970,453 A * 10/1999 Sharman ..... 704/260
6,138,089 A * 10/2000 Guberman ..... 704/207
6,240,384 B1 * 5/2001 Kagoshima et al. ..... 704/220

OTHER PUBLICATIONS

X. Huang, et al., "Recent Improvements on Microsoft's Trainable Text–to–Speech System—Whistler", Proc. of ICASSP97, Apr. 1997, pp. 959–962.

* cited by examiner

*Primary Examiner*—David D. Knepper
(74) *Attorney, Agent, or Firm*—Oblon, Spivak, McClelland, Maier & Neustadt, P.C.

(57) ABSTRACT

A representative pattern memory stores a plurality of initial representative patterns as a noise pattern. Different attribute is affixed to each initial representative pattern. A pitch pattern memory stores a large number of natural pitch patterns as an accent phrase. A clustering unit classifies each natural pitch pattern to the initial representative pattern based on the attribute of the accent phrase. A transformation parameter generation unit calculates an error between a transformed representative pattern and each natural pitch pattern classified to the initial representative pattern. A representative pattern generation unit calculates an evaluation function of the sum of the error between the transformed-representative pattern and each natural pitch pattern classified to the initial representative pattern, and updates each initial representative pattern. The representative pattern memory stores each updated representative pattern as a clustered pattern of the attribute affixed to the corresponding initial representative pattern.

26 Claims, 10 Drawing Sheets

ATTRIBUTE

| ACCENT TYPE | NUMBER OF MORA | PART OF SPEECH | PHONEME | REPRESENTATIVE PATTERN ( CLUSTER) |
|---|---|---|---|---|
| 0 TYPE | 2 | NOUN | / a /, / i / | 1 |
| ⋮ | ⋮ | ⋮ | ⋮ | ⋮ |

FIG.4

| REPRESENTATIVE PATTERN (CLUSTER) | CLUSTERING (ACCENT PHRASE NUMBER) |
|---|---|
| 1 | 1, 3, 5, N-2 |
| 2 | 2, 4, 6, N-1 |
| ⋮ | ⋮ |
| n | 10, 12, 15, N |

FIG.5

ATTRIBUTE

| ACCENT TYPE | NUMBER OF MORA | PART OF SPEECH | PHONEME | TRANSFORMATION PARAMETER |
|---|---|---|---|---|
| 0 TYPE | 2 | NOUN | / a /, / i / | PARALLERL MOVE QUANTITY ALONG FREQUENCY AXIS ⇒ 5(OCTAVE) |
| ⋮ | ⋮ | ⋮ | ⋮ | ⋮ |

CLUSTERED PATTERNS FOR TEXT-TO-SPEECH SYNTHESIS

FIELD OF THE INVENTION

The present invention relates to a speech information processing apparatus and a method to generate a natural pitch pattern used for text-to-speech synthesis.

BACKGROUND OF THE INVENTION

Text-to-synthesis represents the artificial generation of a speech signal from an arbitrary sentence. An ordinary text-to-speech system consists of a language processing section, a control parameter generation section, and a speech signal generation section. The language processing section executes morpheme analysis and syntax analysis for an input text. The control parameter generation section processes accent and intonation, and outputs phoneme signs, pitch pattern, and the duration of phoneme. The speech signal generation section synthesizes the speech signal.

In the text-to-speech system, an element related to the naturalness of synthesized speech is the prosody processing of the control parameter generation section. In particular, pitch pattern influences the naturalness of synthesized speech. In known text-to-speech systems, pitch pattern is generated by a simple model. Accordingly, the synthesized speech is generated as mechanical speech whose intonation is unnatural.

Recently, a method to generate the pitch pattern by using a pitch pattern extracted from natural speech has been considered. For example, in Japanese Patent Disclosure (Kokai) "PH6-236197", unit patterns extracted from the pitch pattern of natural speech or vector-quantized unit patterns are previously memorized. The unit pattern is retrieved from a memory by input attribute or input language information. By locating and transforming the retrieved unit pattern on a time axis, the pitch pattern is generated.

In the above-mentioned text-to-speech synthesis, it is impossible to store the unit patterns suitable for all input attributes or all input language informations. Therefore, transformation of the unit pattern is necessary. For example, elasticity of the unit pattern in proportion to the duration is necessary. However, even if the unit pattern is extracted from the pitch pattern of the natural speech, the naturalness of the synthesized speech falls because of this transformation processing.

SUMMARY OF THE INVENTION

It is one object of the present invention to provide a speech information processing apparatus and a method to improve the naturalness of synthesized speech in text-to-speech synthesis.

The above and other objects are achieved according to the present invention by providing a novel apparatus, method and computer program product for generating clustered patterns for text-to-speech synthesis. In the apparatus, a representative pattern memory stores a plurality of initial representative patterns as a noise pattern. Different attribute is previously affixed to each initial representative pattern. A pitch pattern memory stores a large number of natural pitch patterns as an accent phrase. A clustering unit classifies each natural pitch pattern to the initial representative pattern based on the attribute of the accent phrase. A transformation parameter generation unit evaluates an error between a transformed representative pattern and each natural pitch pattern classified to the initial representative pattern, and generates a transformation parameter for each natural pitch pattern based on the evaluation result. A representative pattern generation unit calculates an evaluation function of the sum of the error between the transformed representative pattern an each natural pitch pattern classified to the initial representative pattern, and updates each initial representative pattern based on a result of the evaluation function. The representative pattern memory stores each updated representative pattern as a clustered pattern of the attribute affixed to the corresponding initial representative pattern.

BRIEF DESCRIPTION OF THE DRAWINGS

FIG. 4 is a schematic diagram of the data format of a representative pattern selection rule in FIG. 1.

FIG. 5 is a schematic diagram of example of processing in a clustering section of FIG. 1.

DETAILED DESCRIPTION OF THE PREFERRED EMBODIMENTS

Figure 1A:
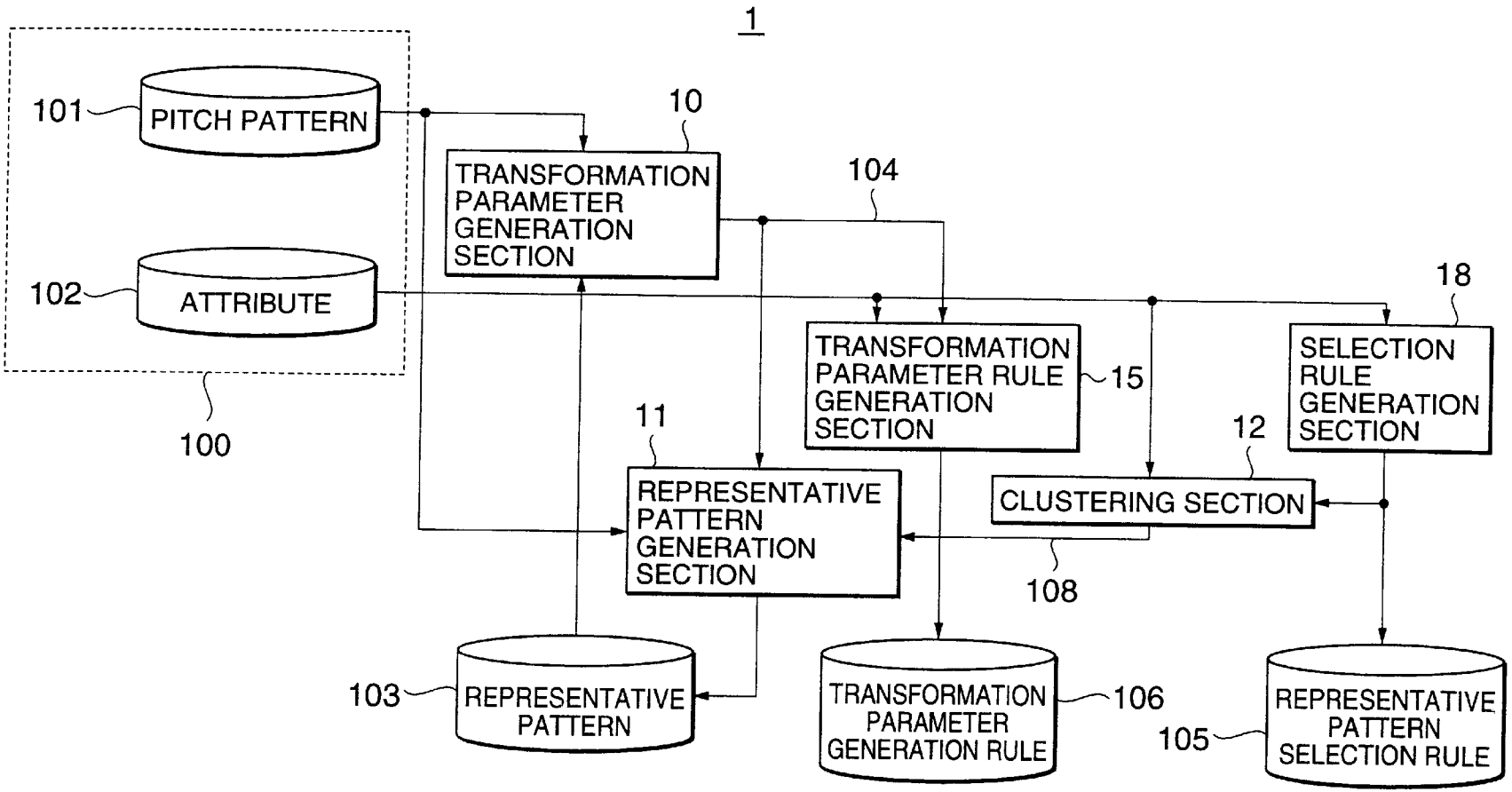
FIG. 1A is a block diagram of a learning system in the speech information processing apparatus according to a first embodiment of the present invention.

Embodiments of the present invention will be explained referring to the Figures. As specific feature of the present invention, in a learning system, a plurality of initial representative patterns (For example, a noise pattern) are prepared, and the initial representative pattern is transformed using natural pitch patterns of same attribute so that the transformed representative pattern is almost equal to the natural pitch pattern. The natural pitch patterns of same attribute include almost same time change of fundamental frequency. As a result, the representative pattern becomes a clustered pattern of time change of fundamental frequency for the same attribute. Accordingly, in a pitch control system, the synthesized speech including naturalness similar to natural speech is generated using the representative pattern.

First, technical terms used in the embodiments are explained.

A prosody unit is a unit of pitch pattern generation, which can include, for example, (1) an accent phrase, (2) a divided unit of the accent phrase into a plurality of sections by shape of the pitch pattern, and/or (3) a unit including boundary of continuous accent phrases. As for the accent phrase, a word may be regarded as the accent phrase. Otherwise, "an article + a word" or "a preposition + a word" may be regarded as the accent phrase. Hereinafter, the prosody unit is defined as the accent phrase.

The transformation of the representative pattern is the operation to be almost equal to the natural pitch pattern, and includes , for example, (1) elasticity on a time axis (change of duration), (2) parallel move on a frequency axis (shift of frequency), (3) differentiation, integration of filtering, and/or (4) a combination of (1) (2) (3). This transformation is executed for a pattern in a time-frequency area or a time-logarithm frequency area.

A cluster is the representative pattern corresponding to the same attribute of the prosody units. Clustering is the operation to classify the prosody unit to the cluster according to a predetermined standard. As the standard, an error between a pattern generated from the representative pattern and a natural pitch pattern of the prosody unit, an attribute of the prosody unit, or a combination of the error and the attribute is used.

The attribute of the prosody unit is a grammatical feature related to the prosody unit or neighboring prosody unit extracted from speech data including the prosody unit or text corresponding to the speech data. For example, the attribute is the accent type, number of mora, part of speech, or phoneme.

An evaluation function is a function to evaluate a distortion (error) of the pattern transformed from one representative pattern and a plurality of the prosody units classifying to the one representative pattern. For example, the evaluation function is a function defined between the transformed representative pattern and natural pitch pattern of the prosody units, or a function defined between the logarithm of the transformed representative pattern and the logarithm of the natural pitch pattern, which is used as a sum of the error squared.

Figure 1B:
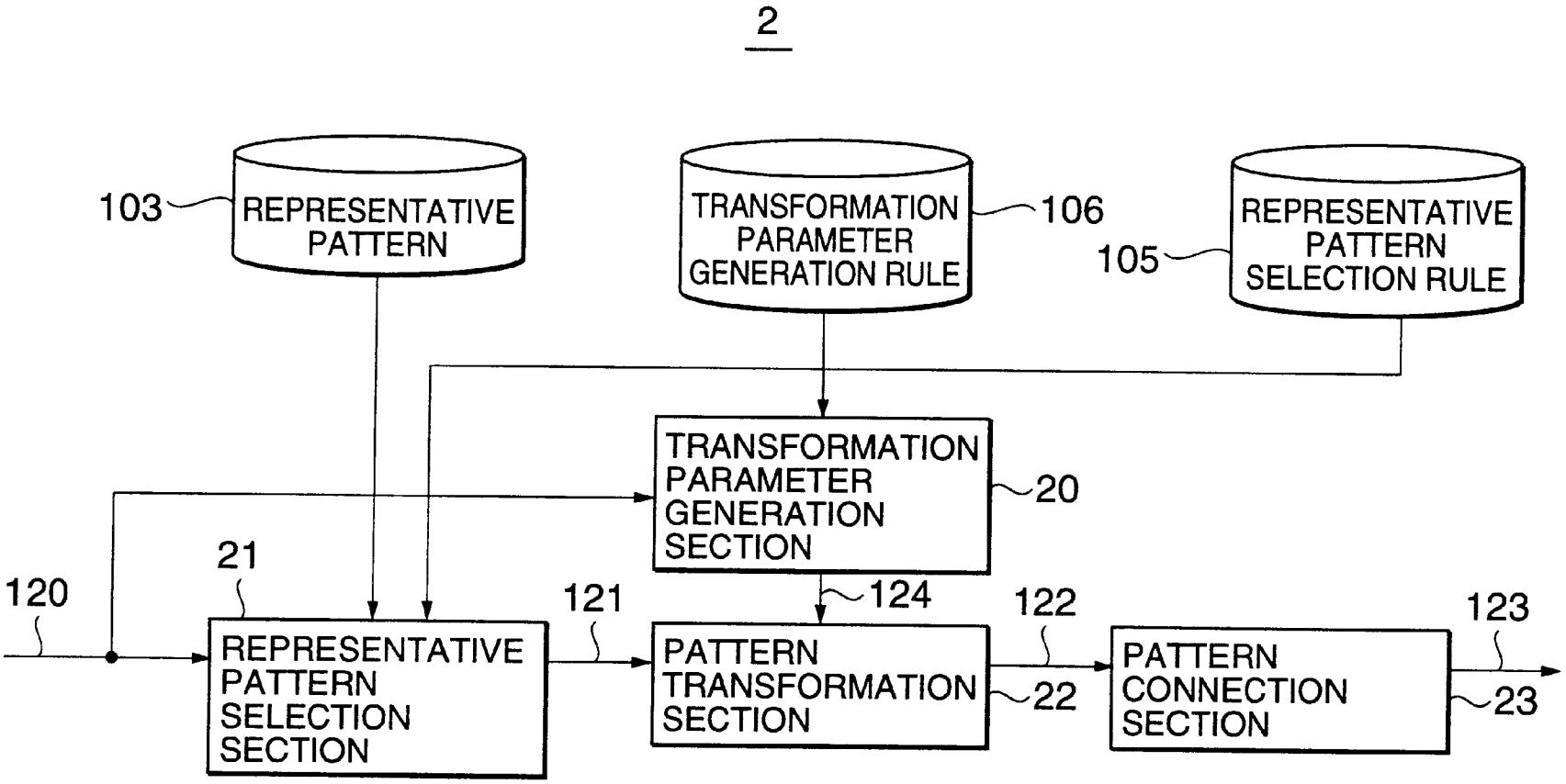
FIG. 1B is a block diagram of a pitch control system in the speech information processing apparatus according to the first embodiment of the present invention.
Figure 2:
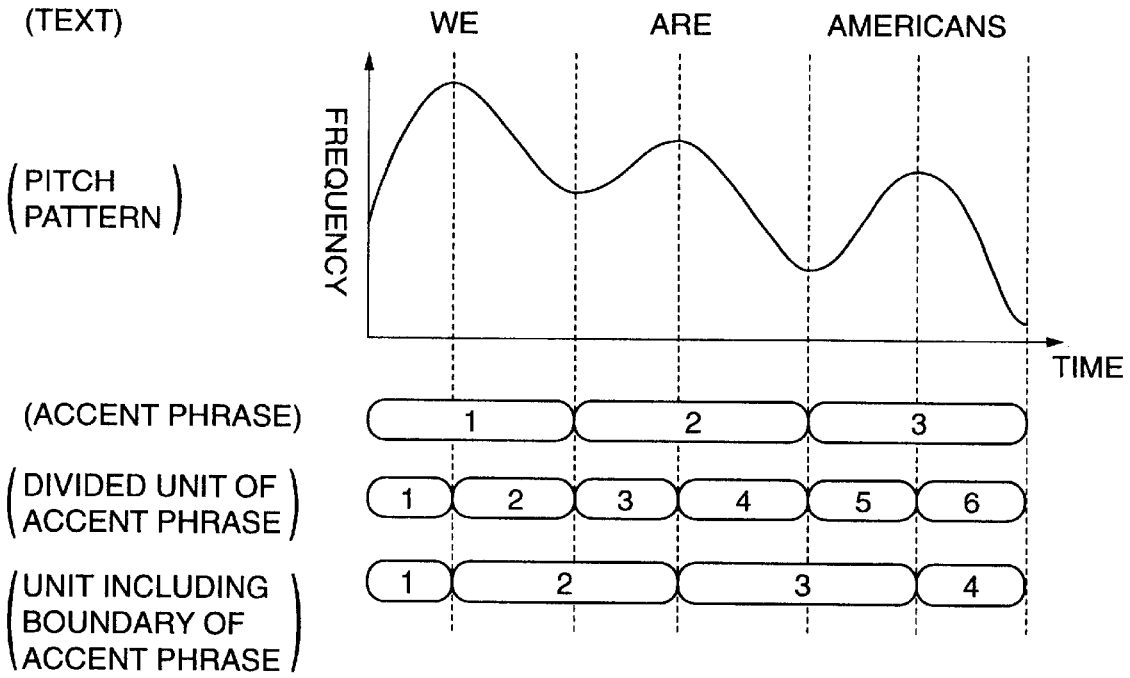
FIG. 2 is a schematic diagram of examples of a prosody unit.

FIGS. 1A and 1B are block diagrams of the speech information processing apparatus according to the first embodiment of the present invention. The speech information processing apparatus is comprised of a learning system 1 (FIG. 1A) and a pitch control system 2 (FIG. 1B). The learning system 1 generates the representative pattern and the transformation parameter by learning in advance. The pitch control system 2 actually executes text-to-speech synthesis.

First, the learning system 1 is explained. As shown in FIG. 1A, the learning system 1 generates the representative pattern 103, a transformation parameter generation rule 106, and a representative pattern selection rule 105 by using a large quantity of pitch pattern 101 and the attribute 102 corresponding to the pitch pattern 101. The pitch pattern 101 and the attribute 102 are previously prepared for the learning system 1 as explained later.

Figure 3:
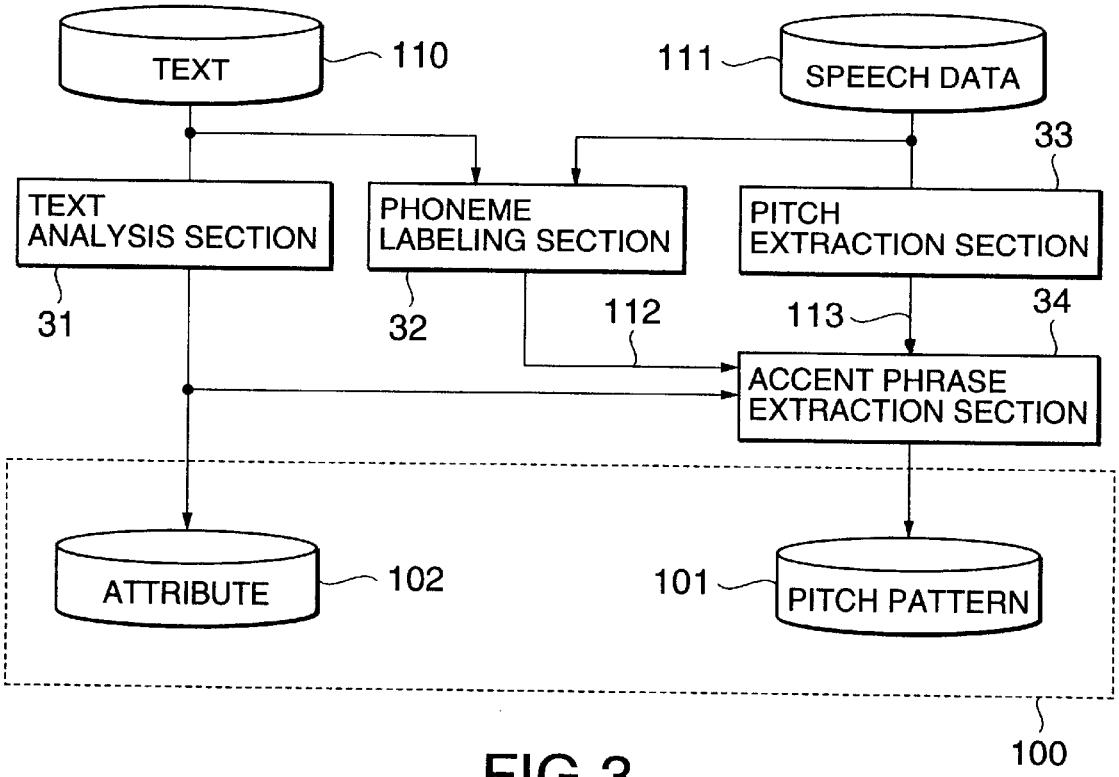
FIG. 3 is a block diagram of a generation apparatus of a pitch pattern and attribute.

FIG. 3 is a block diagram of an apparatus to generate the pitch pattern 101 and the attribute 102 for the learning system 1. The speech data 111 represents a large quantity of natural speech data continuously uttered by many persons. The text 110 represents sentence data corresponding to the speech data 111. The text analysis section 31 executes morpheme analysis for the text 110, divides the text into the accent phrase unit, and decides the attribute of each accent phrase. The attribute 102 is information related to the accent phrase or neighboring accent phrase, for example, the accent type, the number of mora, the part of speech, or phoneme. A phoneme labeling section 32 detects the boundary between the phonemes according to the speech data 111 and corresponding text 110, and assigns phoneme label 112 to the speech data 111. A pitch extraction section 33 extracts the pitch pattern from the speech data 111. In short, the pitch pattern as the time change pattern of the fundamental frequency is generated for all text and outputted as sentence pitch pattern 113. An accent phrase extraction section 34 extracts the pitch pattern of each accent phrase from the sentence pitch pattern 113 by referring to the phoneme label 112 and the attribute 102, and outputs the pitch pattern 101. In this way, the pitch pattern 101 and the attribute 102 of each accent phrase are prepared. These data 100 are used in the learning system of FIG. 1A.

Next, the processing of the learning system 1 is explained in detail. In advance of the learning, assume that n units of the initial representative pattern are previously set. This initial representative pattern may include suitable characteristic prepared by foresight knowledge or may be used as noise data. In short, any pattern data can be used as the initial representative pattern. First, a selection rule generation section 18 generates a representative pattern selection rule 105 by referring to the attribute of the accent phrase 102 and the foresight knowledge of the pitch pattern. FIG. 4 shows the data format of the representative pattern selection rule 105. As shown in FIG. 4, the representative pattern selection rule 105 is a rule to select the representative pattern by the attribute of the accent phrase. In short, the cluster to which the accent phrase belongs is determined by the attribute of the accent phrase or the attribute of the neighboring accent phrase. A clustering section 12 assigns each accent phrase to a cluster based on the attribute 102 of the accent phrase and the representative pattern selection rule 105. FIG. 5 is a schematic diagram of the clustering according to which each accent phrase (1~N) is classified by unit of representative pattern (1~n). In FIG. 5, each representative pattern (1~n) corresponds to each cluster (1~n). All accent phrases (1~N) are classified into n clusters (representative patterns), and cluster information 108 is outputted. A transformation parameter generation section 10 generates the transformation parameter 104 so that the transformed representative pattern 103 closely resembles the pitch pattern 101.

Figure 6A:
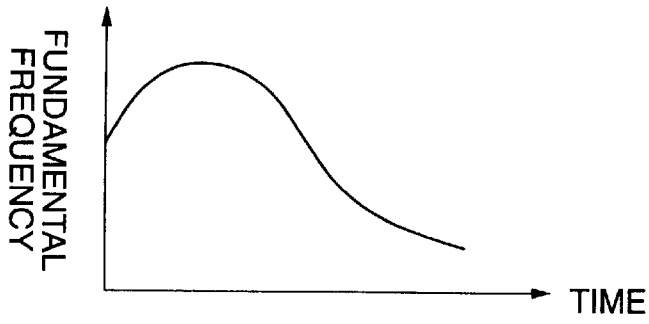
FIGS. 6A–6E show examples of transformation of representative pattern according to the present invention.
Figure 6B:
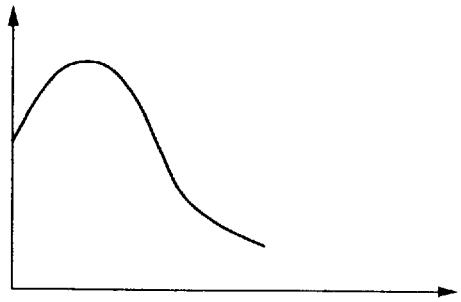
Figure 6C:
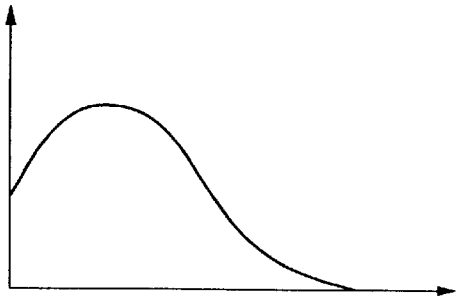
Figure 6D:
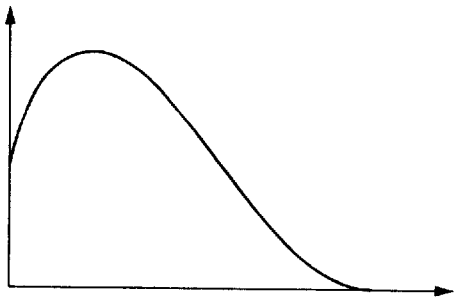
Figure 6E:
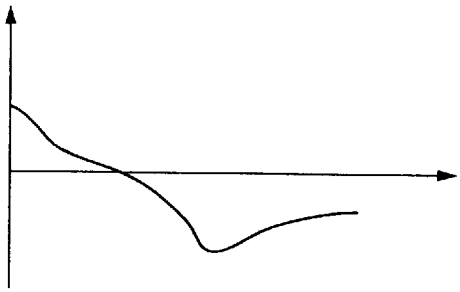

Assume that the representative pattern 103 is a pattern representing the change in the fundamental frequency as shown in FIG. 6A. In FIG. 6A, a vertical axis represents a logarithm of the fundamental frequency. The transformation of the pattern is realized by a combination of the elasticity along the time axis, the elasticity along the frequency axis, the parallel movement along the frequency axis, differentiation, integration, and filtering. FIG. 6B shows an example of the elastic representative pattern along the time axis. FIG. 6C shows an example of the parallel movement of the representative pattern along the frequency axis. FIG. 6D shows an example of the elastic representative pattern along the frequency axis. FIG. 6E shows an example of a differentiated representative pattern. The elasticity along the time axis may be non-linear elasticity by using the duration while excluding the linear-elasticity. These transformations are executed for a pattern of the logarithm of the fundamental frequency or pattern of the fundamental frequency. Furthermore, as the representative pattern 103, a pattern representing inclination of fundamental frequency, which is obtained by differentiation of the pattern of fundamental frequency, may be used.

Assume that a combination of the transformation processing is a function "f( )", the representative pattern is vector "u", and the transformed representative pattern is vector "S" as follows.

$$S=f(p, u) \quad (1)$$

A vector "$P_{ij}$" as the transformation parameter 104 for the representative pattern "$u_i$" to closely resemble the pitch pattern "$r_j$" is determined to search "$p_{ij}$" to minimize the error "$e_{ij}$" as follows.

$$e_{ij}=(r_j-f(p_{ij}, u_i))^T (r_j-f(p_{ij}, u_i)) \quad (2)$$

Figures 7, 8:
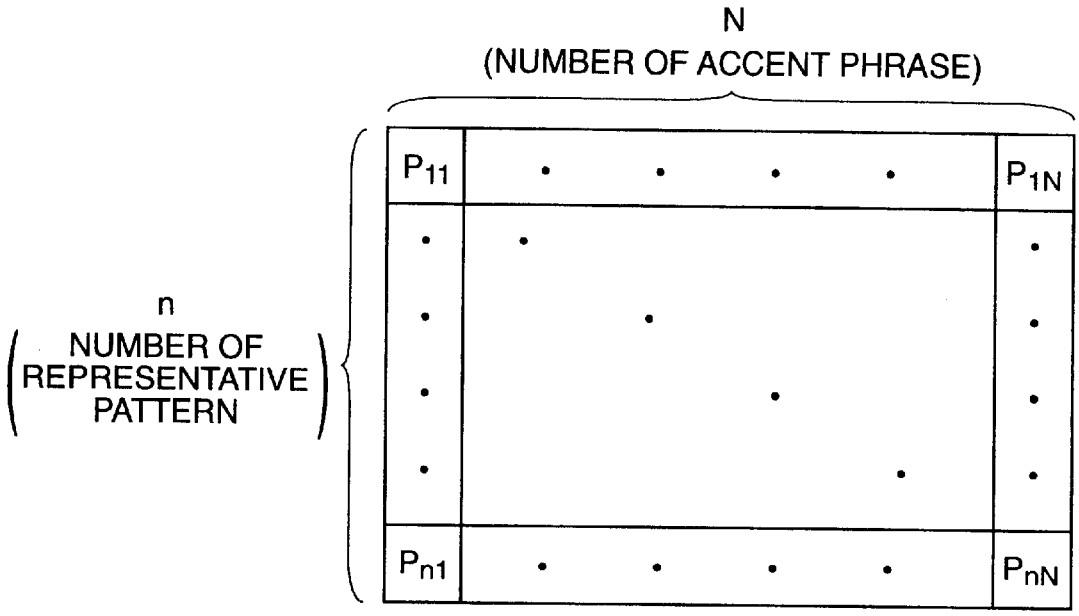
FIG. 7 is a schematic diagram of a format of a transformation parameter generated by a transformation parameter generation section in FIG. 1.
FIG. 8 is a schematic diagram of the data format of a transformation parameter generation rule in FIG. 1.

The transformation parameter is generated for each combination of all accent phrases (1~N) of the pitch pattern 101 and all representative patterns (1~n). Therefore, as shown in FIG. 7, n×N units of the transformation parameter $P_{ij}$(i=1 . . . n) (j=1 . . . N) are generated. A representative pattern generation section 11 generates the representative pattern 103 by unit of the cluster according to the pitch pattern 101 and the transformation parameter 104. The representative pattern $u_i$ of i-th cluster is determined by solving the following equation in which the evaluation function $E_i$ ($u_i$) is partially differentiated by $u_i$.

$$E_i(u_i)=0 \quad (3)$$

The evaluation function $E_i$ ($u_i$) represents the sum of errors when the pitch pattern $r_j$ of the cluster closely resembles the representative pattern $u_i$. The evaluation function is defined as follows.

$$E_i(u_i) = \sum_j (r_j - f(p_{ij}, u_i))^T (r_j - f(p_{ij}, u_i)) \quad (4)$$

In above equation, "$r_j$" represents the pitch pattern belonging to i-th cluster. If the equation (4) is not partially differentiated, or the equation (3) is not analytically solved, the representative pattern is determined by searching "$u_i$" to minimize the evaluation function (4) according to the prior optimization method.

Generation of the transformation parameter by the transformation parameter generation section 10 and generation of the representative pattern 103 by the representative pattern generation section 11 are repeatedly executed till the evaluation function (4) converges.

A transformation parameter rule generation section 15 generates the transformation parameter generation rule 106 according to the transformation parameter 104 and attribute 102 corresponding to the pitch pattern 101. FIG. 8 shows the data format of the transformation parameter generation rule 106. The transformation parameter generation rule is a rule to select the transformation parameter by input attribute of each accent phrase in a text to be synthesized, which is generated by a statistical method such as quantized I class or some inductive method.

Next, the pitch control system 2 is explained. As shown in FIG. 1B, the pitch control system 2 refers the representative pattern 103, the transformation parameter generation rule 106, and the representative pattern selection rule 105 according to input attribute 120 of each accent phrase in the text to be synthesized. The attribute 120 is obtained by analyzing the text inputted to the text synthesis system. Then, the pitch control system 2 outputs the sentence pitch pattern 123 as pitch patterns of all sentences in the text. A representative pattern selection section 21 selects a representative pattern 121 suitable for the accent phrase from the representative pattern 103 according to the representative pattern selection rule 105 and the input attribute 120, and outputs the representative pattern 121. A transformation parameter generation section 20 generates the transformation parameter 124 according to the transformation parameter generation rule 106 and the input attribute 120, and outputs the transformation parameter 124. A pattern transformation section 22 transforms the representative pattern 121 by the transformation parameter 124, and outputs a pitch pattern 122 (transformed representative pattern). Transformation of the representative pattern is executed in the same way, as the function "f( )" representing a combination of transformation processing defined by the transformation parameter generation section 10. A pattern connection section 23 connects the pitch pattern 122 of the continuous accent phrases. In order to avoid discontinuity of the pitch pattern at the connected part, the pattern connection section 23 smooths the pitch pattern at the connected part, and outputs the sentence pitch pattern 123.

As mentioned above, in the first embodiment, by unit of the cluster to which the attribute is affixed, the updated representative pattern is generated by the evaluation function of the error between a pattern (the transformed representative pattern) transformed from last representative pattern and the natural pitch corresponding to the same attribute of natural speech in the learning system 1. Then, in the pitch control system 2, a pitch pattern of text-to-speech synthesis is generated by using the updated representative pattern. Therefore, synthesized speech that is highly natural is outputted without unnaturalness because of transformation.

Figure 9:
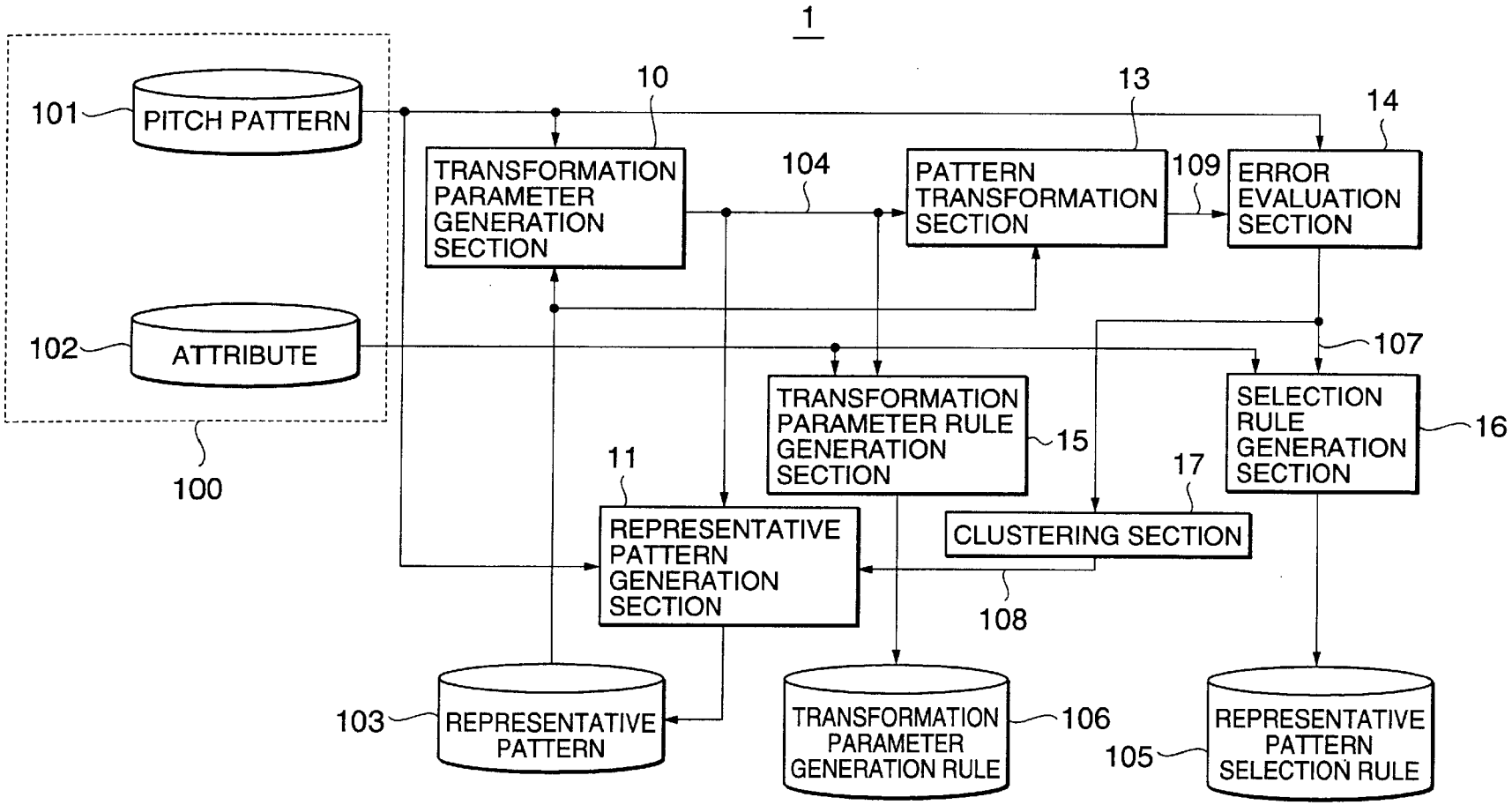
FIG. 9 is a block diagram of the learning system in the speech information processing apparatus according to a second embodiment of the present invention.

FIG. 9 is a block diagram of the learning system 1 in the speech information processing apparatus according to the second embodiment of the present invention. In the second embodiment, a clustering method of the pitch pattern and a generation method of the representative pattern selection rule are different than in the first embodiment. In short, in the first embodiment, the representative pattern selection rule is generated according to the foresight, knowledge, and distribution of the attribute, and a plurality of accent phrases are classified according to the representative pattern selection rule. However, in the second embodiment, based upon the error between a pattern transformed from the representative pattern and the natural pitch pattern extracted from the speech data, a plurality of accent phrases are classified (clustering) and the representative pattern selection rule is generated.

First, the transformation parameter generation section 10 generates the transformation parameter 104 so that a pattern transformed from the initial representative pattern 103 closely resembles the pitch pattern 101 of each accent phrase for learning. Next, a clustering method of the pitch pattern is explained in detail. A pattern transformation section 13 transforms the initial representative pattern 103 according to the transformation parameter 104, and outputs the pattern 109 (transformed representative pattern). Transformation of the representative pattern is executed by the function "f( )" as a combination of the transformation processing defined by the transformation parameter generation section 10. As for the pitch pattern $r_j$ (j=1 . . . N) of N units of accent phrase, n units of the pattern $s_{ij}$ (i=1 . . . n) (j=1 . . . N) are generated by transforming n units of the initial representative pattern $u_i$ (i=1 . . . n). The error evaluation section 14 evaluates an error between the pitch pattern 101 and the transformed pattern 109, and outputs the error information 107. The error is calculated as follows.

$$e_{ij}=(r_j-s_{ij})^T (r_j-s_{ij}) \quad (5)$$

Figure 10:
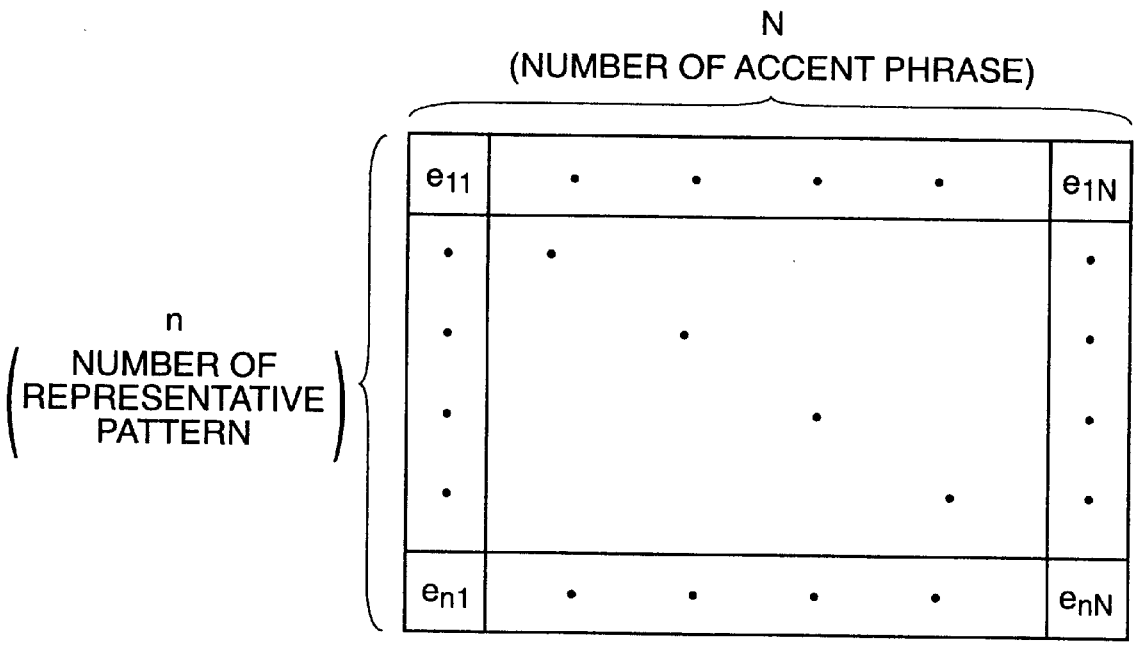
FIG. 10 is a schematic diagram of a format of error calculated by the error evaluation section in FIG. 9.

The error $e_{ij}$ is generated for each combination of all accent phrases of the pitch pattern 101 and all of the initial representative pattern 103. FIG. 10 is a schematic diagram of the format of the error calculated by the error evaluation section. As shown in FIG. 10, n×N units of the error "$e_{ij}$" (i=1 . . . n) (j=1 . . . N) are generated. The clustering section 17 classifies N units of the pitch pattern 101 to n units of the cluster corresponding to the representative pattern according to the error information 107 in the same way as FIG. 5, and outputs the cluster information 108. If the cluster corresponding to the representative pattern $u_i$ is represented as $G_i$, the pitch pattern $r_j$ is classified (clustering) by the error $e_{ij}$ as follows.

$$G_i=\{r_j|e_{ij}=\min[e_{ij}, \ldots, e_{nj}]\} \quad (6)$$

$\min[X_1, \ldots, X_n]$: minimum value of $(X_1, \ldots, X_n)$

Then, the representative pattern generation section 11 generates the representative pattern 103 according to the pitch pattern 101 and the transformation parameter 104 by unit of the cluster 108. In the same way as the first embodiment, the generation of the transformation parameter, the clustering, and the generation of the representative pattern are repeatedly executed until the evaluation function (4) converges. When the above-mentioned processing is completed, the transformation parameter rule generation section 15 generates the transformation parameter generation rule 106, and the selection rule generation section 16 generates the representative pattern selection rule 105. In this case, when the evaluation function (4) converges, the selection rule generation section 16 generates the representative pattern selection rule 105 by the error information 107 of the convergence result and the attribute 102 of the pitch pattern 101. As shown in FIG. 4, the representative pattern selection rule 105 is a rule to select the representative pattern by the attribute, which is generated by a statistical method such as quantized I class or some inductive method.

As mentioned above, in the learning system of the second embodiment, whenever the errors between each combination of all patterns transformed from the representative patterns and all pitch patterns of natural speech are generated as shown in FIG. 10, each pitch pattern of natural speech is classified to the cluster. Whenever this clustering is executed, the updated representative pattern 103 is generated for each cluster. When the evaluation function of the error is converged, the representative pattern selection rule 105 and the transformation parameter generation rule 106 are stored as the convergence result. Then, in the pitch control system, a suitable representative pattern 103 corresponding to input attribute of each accent phrase in the text to be synthesized is selected by referring to the representative pattern selection rule 105, and the selected representative pattern is transformed by referring to the transformation parameter generation rule 106 in order to generate a sentence pitch pattern. Therefore, synthesized speech similar to natural speech is outputted by using the sentence pitch pattern.

Figure 11:
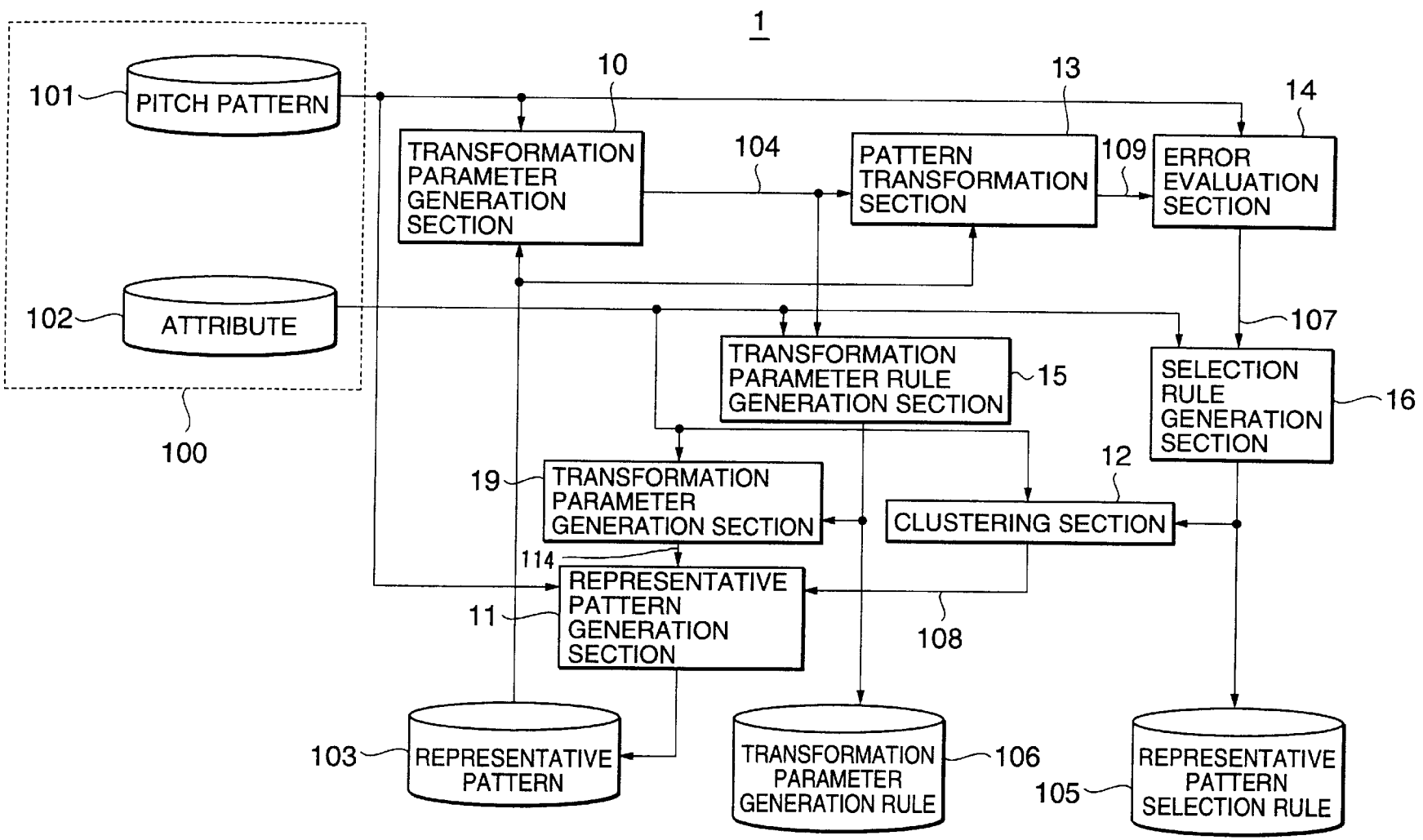
FIG. 11 is a block diagram of the learning system in the speech information processing apparatus according to a third embodiment of the present invention.

FIG. 11 is a block diagram of the learning system 1 in the speech information processing apparatus according to the third embodiment of the present invention. In the third embodiment, the transformation parameter to input to the representative pattern generation section 11 and a generation method of the cluster information are different from the first and second embodiments. In short, in the first and second embodiments, the updated representative pattern is generated by using suitable transformation parameter generated from the representative pattern 103 and the pitch pattern 101. However, in the third embodiment, the representative pattern is updately generated by using the transformation parameter generated from the transformation parameter generation rule 106 and the pitch pattern 101.

In the third embodiment, the transformation parameter generation section 19 generates the transformation parameter 114 according to the last transformation parameter generation rule 106 and the attribute 102. The representative pattern generation section 11 updates the representative pattern according to the transformation parameter 114 and the pitch pattern 101.

Whenever the error evaluation section 14 evaluates the errors between each combination of all pitch patterns transformed from the representative patterns and all pitch patterns of natural speech are generated as shown in FIG. 10, the selection rule generation section 16 generates the representative pattern selection rule 105 according to the evaluated error and the attribute 102 as shown in FIG. 4. The clustering section 12 determines the cluster to which the pitch pattern 101 is classified according to the representative pattern selection rule 105 and the attribute 102 of each pitch pattern 101. By classifying all pitch patterns 101 to n units of the cluster corresponding to the representative pattern, the clustering section 12 outputs cluster information 108 as shown in FIG. 5.

In short, in the third embodiment, a generation of the transformation parameter, a generation of the transformation parameter generation rule, a generation of the representative pattern selection rule, the clustering, and the generation of the representative pattern are executed as a series of processings. In this case, the generation of the transformation parameter generation rule is independently executed at arbitrary timing from the generation of the representative pattern selection rule and the clustering if a generation timing of the transformation parameter generation rule is located between the generation of the transformation parameter and the generation of the representative pattern. This series of processings is repeatedly executed till the evaluation function (4) is converged. After the series of processings is completed, the transformation parameter generation rule 106 and the representative pattern selection rule 105 at the timing are respectively adopted. Furthermore, these rules may be calculated again by using the representative pattern obtained last.

As mentioned above, in the learning system of the third embodiment, whenever the error between each combination of all patterns transformed from the representation patterns and all pitch patterns of natural speech are generated as shown in FIG. 10, the representation pattern selection rule 105 is generated according to the evaluated error and the attribute 102 as shown in FIG. 4, and each pitch pattern of natural speech is classified to the cluster as shown in FIG. 5. Whenever this clustering is executed, the updated representation pattern 103 is generated for each cluster. When the evaluation function of this error converges, the transformation parameter generation rule 106 and the representative pattern selection rule 105 at this timing are adopted as the convergence result. Then, in the pitch control system, a suitable representative pattern 103 corresponding to the input attribute is selected by referring to the representative pattern selection rule 105, and the selected representative pattern is transformed by referring to the transformation parameter generation rule 106 in order to generate a sentence pitch pattern. Therefore, synthesized speech similar to natural speech is outputted by using the sentence pitch pattern.

In the first, second, and third embodiments, the speech information processing apparatus consists of the learning system 1 and the pitch control system 2. However, the speech information processing apparatus may consist of the learning system 1 only, the pitch control system 2 only, the learning system 1 excluding memory of the representative pattern 103, the transformation parameter generation rule 106 and the representative pattern selection rule 105, or the pitch control system 2 excluding memory of the representative pattern 103, the transformation parameter generation rule 106 and the representative pattern selection rule 105.

A memory can be used to store instructions for performing the process of the present invention described above, such a memory can be a hard disk, semiconductor memory, and so on.

Other embodiments of the invention will be apparent to those skilled in the art from consideration of the specification and practice of the invention disclosed herein. It is intended that the specification and examples be considered as exemplary only, with the true scope and spirit of the invention being indicated by the following claims.

What is claimed is:

1. An apparatus for generating clustered patterns for text-to-speech synthesis, comprising:

representative pattern memory configured to store a plurality of initial representative patterns, each initial representative pattern being a noise pattern, an attribute being differently affixed to each initial representative pattern, the attribute including at least accent type;

pitch pattern memory configured to store a large number of natural pitch patterns for learning, each natural pitch pattern being an accent phrase in a sentence and including the attribute of the accent phrase;

clustering unit configured to classify each natural pitch pattern to the initial representative pattern, the natural pitch patterns of same attribute being classified to one initial representative pattern of the same attribute;

transformation parameter generation unit configured to respectively generate a transformation parameter for each natural pitch pattern by evaluating an error between a transformed representative pattern and each natural pitch pattern classified to the initial representative pattern from which the transformed representative pattern is generated;

representative pattern generation unit configured to update each initial representative pattern by calculating an evaluation function of the sum of the error between the transformed representative pattern and each natural pitch pattern classified to the initial representative pattern; and wherein said representative pattern memory stores each updated representative pattern as a clustered pattern of the attribute affixed to the initial representative pattern from which the updated representative pattern is generated.

2. The apparatus according to claim 1, wherein the natural pitch pattern represents a time change of fundamental frequency.

3. The apparatus according to claim 2, wherein the transformation parameter represents one of a change of duration along a time axis, and a shift of frequency along a frequency axis.

4. The apparatus according to claim 1, wherein the attribute of the accent phrase includes accent type, number of mora, part of speech, and phoneme.

5. The apparatus according to claim 1, wherein said representative pattern memory stores a plurality of clustered patterns each corresponding to a different attribute affixed to each initial representative pattern.

6. The apparatus according to claim 1, wherein said transformation parameter generation unit repeats generation of the transformation parameter, and said representative pattern generation unit repeats update of the representative pattern, until the evaluation function satisfies a predetermined condition.

7. The apparatus according to claim 6, wherein said representative pattern memory stores the updated representative pattern, when the evaluation function satisfies the predetermined condition.

8. The apparatus according to claim 7, further comprising:

a transformation parameter generation rule memory being configured to store the transformation parameter and the attribute of the natural pitch pattern of which the error is evaluated, when the evaluation function satisfies the predetermined condition.

9. The apparatus according to claim 6, wherein said transformation parameter generation unit generates the transformation parameters for all combinations of each natural pitch pattern and each initial representative pattern.

10. The apparatus according to claim 9, further comprising:

an error evaluation unit being configured to respectively calculate an error between each natural pitch pattern and each transformed representative pattern; and wherein said clustering unit classifies each natural pitch pattern to one initial representative pattern of which the error between the natural pitch pattern and the one initial representative pattern is the smallest among errors between the natural pitch pattern and all transformed representative patterns.

11. The apparatus according to claim 10, whenever said transformation parameter generation unit generates the transformation parameters for all combinations of each natural pitch pattern and each updated representative pattern, until the evaluation function satisfies the predetermined condition, wherein said error evaluation unit repeats calculation of the error, and said clustering unit repeats classification of each natural pitch pattern.

12. The apparatus according to claim 11, further comprising:

a representative pattern selection rule memory being configured to correspondingly store the attribute of the natural pitch patterns classified to each updated representative pattern and an address of the updated representative pattern in said representative pattern memory, when the evaluation function satisfies the predetermined condition.

13. A method for generating clustered patterns for text-to-speech synthesis, comprising the steps of:

storing the plurality of initial representative patterns, each initial representative pattern being a noise pattern, an attribute being differently affixed to each initial representative pattern, the attribute including at least accent type;

storing a large number of natural pitch patterns for learning, each natural pitch pattern being an accent phrase in a sentence and including the attribute of the accent phrase;

classifying each natural pitch pattern to the initial representative pattern, the natural pitch patterns of same attribute being classified to one initial representative pattern of the same attribute;

respectively generating a transformation parameter for each natural pitch pattern by evaluating an error between a transformed representative pattern and each natural pitch pattern classified to the initial representative pattern from which the transformed representative pattern is generated;

updating each initial representative pattern by calculating an evaluation function of the sum of the error between the transformed representative pattern and each natural pitch pattern classified to the initial representative pattern; and storing each updated representative pattern as a clustered pattern of the attribute affixed to the initial representative pattern from which the updated representative pattern is generated.

14. The method according to claim 13, wherein the natural pitch pattern represents a time change of fundamental frequency.

15. The method according to claim 14, wherein the transformation parameter represents one of a change of duration along a time axis, and a shift of frequency along a frequency axis.

16. The method of according to claim 13, wherein the attribute of the accent phrase includes accent type, number of mora, part of speech, and phoneme.

17. The method according to claim 13, further comprising the step of:

storing a plurality of the clustered patterns each corresponding to a different attribute affixed to each initial representative pattern.

18. The method according to claim 13, further comprising the steps of:

repeating generation of the transformation parameter and update of the representative pattern, until the evaluation function satisfies a predetermined condition.

19. The method according to claim 18, further comprising the step of:

storing the updated representative pattern, when the evaluation function satisfies the predetermined condition.

20. The method according to claim 19, further comprising the step of:

storing the transformation parameter and the attribute of the natural pitch pattern of which the error is evaluated, when the evaluation function satisfies the predetermined condition.

21. The method according to claim 18, further comprising the step of:

generating the transformation parameters for all combinations of each natural pitch pattern and each initial representative pattern.

22. The method according to claim 21, further comprising the steps of:

respectively calculating an error between each natural pitch pattern and each transformed representative pattern; and classifying each natural pitch pattern to one initial representative pattern of which the error between the natural pitch pattern and the one initial representative pattern is the smallest among errors between the natural pitch pattern and all transformed representative patterns.

23. The method according to claim 22, further comprising the step of:

whenever the transformation parameters for all combinations of each natural pitch pattern and each updated representative pattern are generated, until the evaluation function satisfies the predetermined condition;

repeating calculation of the error and classification of each natural pitch pattern.

24. The method according to claim 23, further comprising the step of:

correspondingly storing the attribute of the natural pitch patterns classified to each updated representative pattern and an address of the updated representative pattern, when the evaluation function satisfies the predetermined condition.

25. A computer readable memory containing computer readable instructions to generate clustered patterns for text-to-speech synthesis, comprising:

instruction means for causing a computer to store a plurality of initial representative patterns, each initial representative pattern being a noise pattern, an attribute being differently affixed to each initial representative pattern, the attribute including at least accent type;

instruction means for causing a computer to store a large number of natural pitch patterns for learning, each natural pitch pattern being an accent phrase in a sentence and including the attribute of the accent phrase;

instruction means for causing a computer to classify each natural pitch pattern to the initial representative pattern, the natural pitch patterns of same attribute being classified to one initial representative pattern of the same attribute;

instruction means for causing a computer to respectively generate a transformation parameter for each natural pitch pattern by evaluating an error between a transformed representative pattern and each natural pitch pattern classified to the initial representative pattern from which the transformed representative pattern is generated;

instruction means for causing a computer to update each initial representative pattern by calculating an evaluation function of the sum of the error between the transformed representative pattern and each natural pitch pattern classified to the initial representative pattern; and instruction means for causing a computer to store each updated representative pattern as a clustered pattern of the attribute affixed to the initial representative pattern from which the updated representative pattern is generated.

26. A learning apparatus for generating a representative pattern as a typical pitch pattern used for text-to-speech synthesis, comprising:

representative pattern memory means for storing a plurality of representative patterns and attribute data corresponding to each representative pattern, the representative pattern being variously transformed as a pitch pattern of a prosody unit by a transformation parameter, the attribute data being characteristic of the prosody unit to affect the pitch pattern;

clustering means for classifying each of a plurality of prosody units in a text for learning to one of the plurality of representative patterns in said representative pattern memory means according to attribute data of each prosody unit;

extraction means for extracting a natural pitch pattern corresponding to each prosody unit classified to the representative pattern from a plurality of natural pitch patterns corresponding to the text;

transformation parameter generation means for generating the transformation parameter for evaluating an error between the natural pitch pattern and a transformed representative pattern for each prosody unit classified to the representative pattern; and representative pattern generation means for recursively generating the representative pattern by calculating an evaluation function of the sum of the error between the natural pitch pattern and the transformed representative pattern for all prosody units classified to the representative pattern.

* * * * *

UNITED STATES PATENT AND TRADEMARK OFFICE

CERTIFICATE OF CORRECTION

PATENT NO. : 6,529,874 B2
DATED : March 4, 2003
INVENTOR(S) : Kagoshima et al.

It is certified that error appears in the above-identified patent and that said Letters Patent is hereby corrected as shown below:

Title page,
Item [75], should read:

-- [75] Inventors: Takehiko Kagoshima, Hyogo-ken (JP); Takaaki Nii, Osaka-fu (JP); Shigenobu Seto, Hyogo-ken (JP); Masahiro Morita, Hyogo-ken (JP), Masami Akamine, Hyogo-ken (JP); Yoshinori Shiga, Kanagawa-ken (JP) --

Item [45] and the Notice information should read as follows:

-- [45] **Date of Patent: *Mar. 4, 2003**

[*] Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days. --

Signed and Sealed this

Twenty-second Day of July, 2003

JAMES E. ROGAN
*Director of the United States Patent and Trademark Office*